United States Patent [19]

O'Rourke et al.

[11] 4,323,322

[45] Apr. 6, 1982

[54] WARM AIR CANOPY SYSTEM FOR PROVIDING ICE-FREE ZONE

[75] Inventors: J. Cam O'Rourke; G. Roger Pilkington, both of Calgary; Frank G. Bercha, Cochrane Alta. Tolowo, all of Canada

[73] Assignee: Dome Petroleum Limited, Alberta, Canada

[21] Appl. No.: 54,997

[22] Filed: Jul. 5, 1979

[51] Int. Cl.[3] ..... E02B 15/02

[52] U.S. Cl. ..... 405/217; 405/61

[58] Field of Search ..... 405/217, 131, 61; 43/4, 43/4.5

[56] References Cited

U.S. PATENT DOCUMENTS

| | | | |
|---|---|---|---|
| 633,627 | 9/1899 | Taylor et al. | 405/131 |
| 2,700,649 | 1/1955 | Hosford | 405/52 X |
| 3,193,260 | 7/1965 | Lamb | 405/61 X |
| 3,783,627 | 1/1974 | Blurton et al | 405/217 |
| 3,868,825 | 3/1975 | Boyce | 405/131 |
| 3,932,997 | 1/1976 | Best | 405/61 |
| 3,972,199 | 8/1976 | Hudson et al. | 405/217 |
| 4,006,732 | 2/1977 | Schumm | 405/61 X |
| 4,102,144 | 7/1978 | Anders | 405/217 X |
| 4,117,794 | 10/1978 | Sjogren | 405/217 X |

FOREIGN PATENT DOCUMENTS

| | | | |
|---|---|---|---|
| 944965 | 4/1974 | Canada . | |
| 967382 | 5/1975 | Canada . | |
| 981035 | 1/1976 | Canada . | |
| 982832 | 2/1976 | Canada . | |
| 986325 | 3/1976 | Canada . | |
| 995019 | 8/1976 | Canada . | |
| 996765 | 9/1976 | Canada . | |
| 378190 | 6/1973 | U.S.S.R. | 405/131 |
| 600262 | 3/1978 | U.S.S.R. | 405/131 |

*Primary Examiner*—Dennis L. Taylor

*Attorney, Agent, or Firm*—Lerner, David, Littenberg & Samuel

[57] ABSTRACT

Novel methods and means are provided for providing a substantially ice-free zone around a vessel out to 100 feet or more. The method includes the steps of (a) creating a finite substantially enclosed zone completely around the periphery of the vessel above the waterline, such zone including a peripheral zone approaching the waterline; then (b) continuously circulating warm air within the finite substantially enclosed zone; and finally (c) continuously injecting warm air into the peripheral zone to prevent ice formation within the peripheral zone. The apparatus includes (a) a plurality of floating modules disposed around, and each connected at one end to, the vessel; (b) a continuous, downwardly depending skirt extending completely around the outer periphery of the plurality of floating modules; and (c) a water/air heat exchanger in a selected plurality of such floating modules. The combination of the floating canopies around the vessel, and the hot air provides an ice-free zone around the vessel.

8 Claims, 4 Drawing Figures

WARM AIR CANOPY SYSTEM FOR PROVIDING ICE-FREE ZONE

BACKGROUND OF THE INVENTION

1. Field of the Invention

This invention relates to improvements in the drilling of oil and gas wells in polar regions. More particularly, it relates to improved techniques for effectuating such drilling in the wintertime in the Arctic Ocean and more especially in the Beaufort Sea, although it is feasible for application in other areas where similar conditions exist. Still more particularly, it relates to a method and apparatus for providing an ice-free zone around a drillship to enable such wintertime drilling.

2. Description of the Prior Art

At the present time drilling in offshore in offshore Arctic regions is carried out in the summertime either by the use of drillships anchored at a drill site where the risk of impingement by ice floes is minimal, or through the use of artificial islands. Summertime drilling is feasible for depths from 60 feet to 200 feet or more. Artificial islands currently being used in the shallow water regions of the Beaufort Sea become excessively expensive in water depths of 40 feet or greater. It appears uneconomical at the present time to build artificial islands for exploratory drilling wells in water depths exceeding 40 feet. It may be economical to drill production wells from artificial platforms in water depths exceeding 40 feet. Moreover, it is presently not feasible to drill exploratory wells from floating ice islands in the regions where ice movement is too great (i.e., more than a few feet).

One of the chief obstacles to overcome in drilling in Arctic regions is the Arctic park ice. The ice grows to a thickness of approximately 6 feet and is laced with pressure ridges and ice islands which can reach thicknesses of over 100 feet. The park ice moves at speeds from 0 to 20 or more miles per day with an average movement of approximately 2 miles per day.

If drilling were to take place in waters where there was considerable ice movement, a very solid structure would be required in order to withstand the forces exerted upon it by the ice pack and yet to be able to remain on position in order to drill a well. For exploratory drilling operations, a solid bottom founded structure should be provided which could resist the movement of the ice pack and yet would be mobile enough to be transported from one exploratory drilling site to another.

Drilling with structures on the sea bottom has numerous problems. Firstly, there is the problem of designing hulls which could withstand the ice forces from deep ice keels against these structures. In the second place, subsea systems would have problems of buoyancy, life-support systems, power supply, and access for crews and maintenance.

It would, therefore, be desirable to develop another technique that would allow exploratory drilling during winter months. Such system should also be able to extend operational capability into the shorefast ice. This technique has the potential for drilling wells more economically than any other method in the shorefast ice regions. Using this technique, the rate of exploration in the Beaufort Sea would be increased by a factor of from two to four times. This technology of using drillships in shorefast ice could be applied to other regions of the Canadian Arctic. The techniques used for drilling in shorefast ice are a logical step toward developing year-round drilling systems in pack ice regions.

The development of such technology is important since the risks to the environment of a drilling system in the shorefast ice are relatively low. One advantage of operating in shorefast ice is that the ice moves very little throughout the winter. Any oil spilled underneath the ice would be confined to a very small area where it could be removed from the environment.

SUMMARY OF THE INVENTION

Aims of the Invention

The initial problem which the present invention proposes to overcome is the maintenance of a substantially ice-free area around the drillship, and in particular, an ice-free area around a drillship operating in shorefast ice zones during winter.

Accordingly, it is an object of the present invention to provide a method for maintaining an ice-free area around a ship out to at least 100 feet from the vessel.

A further object of the present invention is to provide a method for maintaining the ice-free zone around a drillship using a forced air heating system to distribute air heated by the waste heat of the drillship, in a manner and quantity sufficient to prevent any appreciable ice formation under the barge hulls and roof modules.

A still further object of the present invention is to provide an apparatus for maintaining a substantially ice-free area around a drillship out to at least 100 feet from the vessel, including the combination of a set of floating barges around the perimeter of the ship.

A still further object of the present invention is to provide a method and apparatus which is simple to construct and may be easily deployed.

Statement of Invention

This invention provides a method for using a passive structural matrix for strategic deployment of a drillship's waste heat to combat ice impingement on the drillship. The method employs a system of bargelike modules having forced air heating and peripheral facilities, and a series of intermodular roof sections connecting a set of floating barges around the ship. By this invention, then, a method is provided for providing a substantially ice-free zone around a vessel out to 100 feet or more comprising: (a) creating a finite, substantially enclosed, zone completely around the periphery of the vessel above the waterline, such zone including a peripheral zone approaching the waterline; (b) continuously circulating warm air within the finite, substantially enclosed, zone; and (c) continuously injecting warm air into said peripheral zone to prevent ice formation within the peripheral zone.

This invention also provides a series of such barges wherein each barge has a hull shaped to ride up on ice sheets, while the entire perimeter of the system is enclosed with a flexible skirt which permits ice movement underneath while sealing air within the system.

This invention further provides an apparatus for providing a substantially ice-free zone around a vessel out to 100 feet or more, comprising in combination with the vessel: (a) a plurality of floating modules disposed around, and connected at one end to, the vessel; (b) a continuous, downwardly depending skirt extending completely around the outer periphery of the plurality of floating modules; and (c) a water/air heat exchanger in a selected plurality of the floating modules.

Other Features of the Invention

By one feature of the method of this invention, the warm air is generated by the steps of circulating warm waste water from the vessel through water/air heat exchangers.

By another feature of such method, the step of continuously circulating warm air includes the step of providing a series of closed loop recirculating sub-zones of warm air.

By one feature of the apparatus of this invention, the plurality of floating modules comprises a series of alternating floating barges interconnected by roof modules.

By another feature of this apparatus, each floating module comprises a floating barge including a floating barge section and a canti-levered canopy section.

BRIEF DESCRIPTION OF THE DRAWINGS

In the accompanying drawings.

DETAILED DESCRIPTION OF PREFERRED EMBODIMENTS

Figure 1:
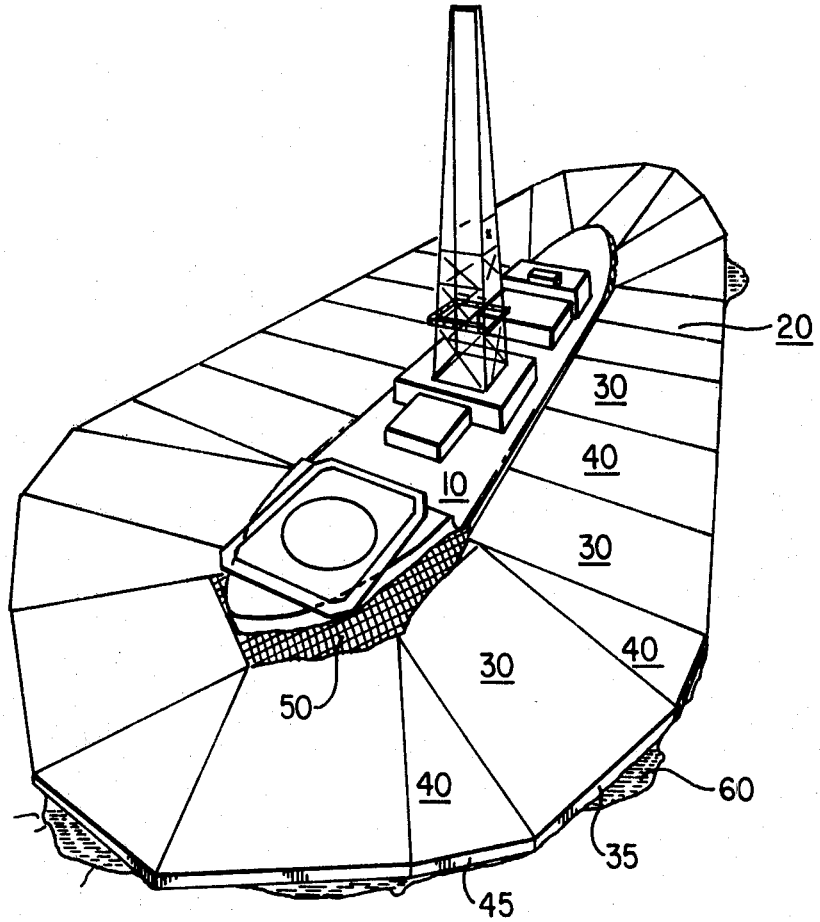
FIG. 1 is a perspective of an embodiment of an apparatus of the present invention.

Description of FIG. 1

Referring to FIG. 1, a drillship 10 is shown, the drillship being generally of the type used in offshore drilling operations and particularly in Arctic zones. When operating in this environment, there is a severe hazard associated with the effect of ice encroaching on the drillship itself and consequently, the invention disclosed and claimed in copending U.S. application Ser. No. 054,661, filed on July 5,1979, (the relevant contents of which are incorporated herein by reference) provided on ice-free zone close to the drillship. Another manner of maintaining such substantially ice-free zone around the drillship involves the deployment of such canopy system of this invention about the perimeter of the drillship, as shown in FIG. 1.

As seen in FIG. 1, the canopy system 20 includes floating modules 30 and roof modules 40, as well as membrane 50 which covers the non-linear areas in close proximity with the drillship 10 and within the periphery of the canopy system not covered by floating modules 30 and roof modules 40. Floating modules 30 and roof modules 40 are provided with flexible downwardly depending skirts 35 and 45, respectively, which extend downwardly from the outer edge of floating module 30 and roof module 40 to slightly below the water surface 60.

Figure 2:
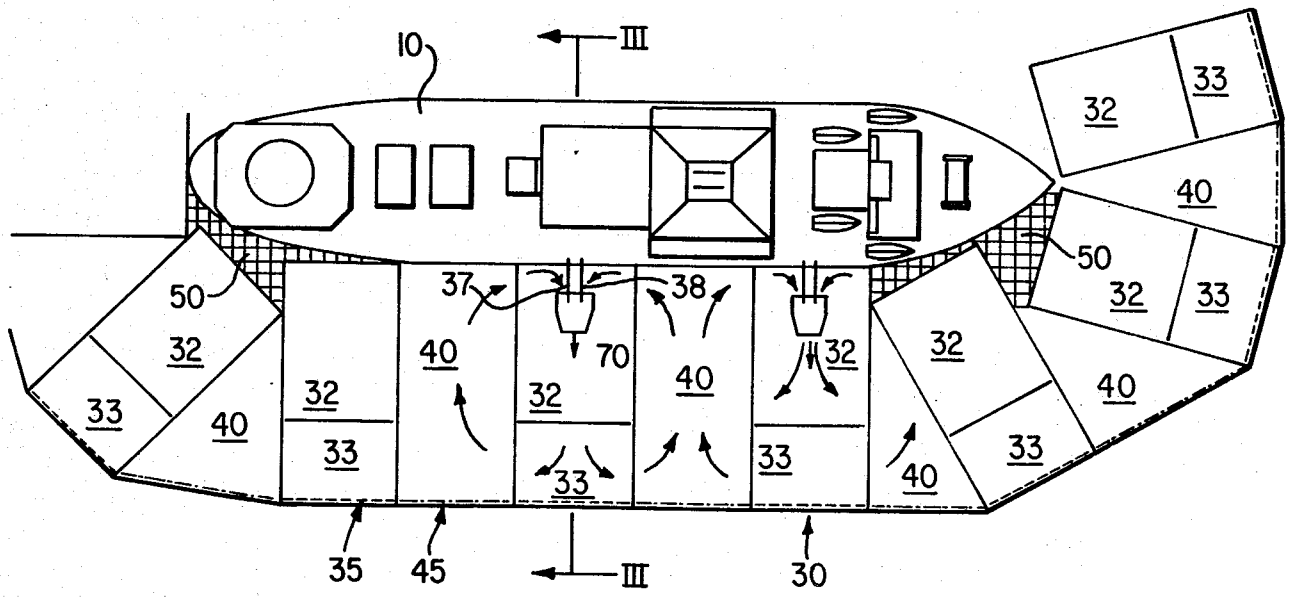
FIG. 2 is a partial top view of an embodiment of apparatus of the present invention.
Figure 3:
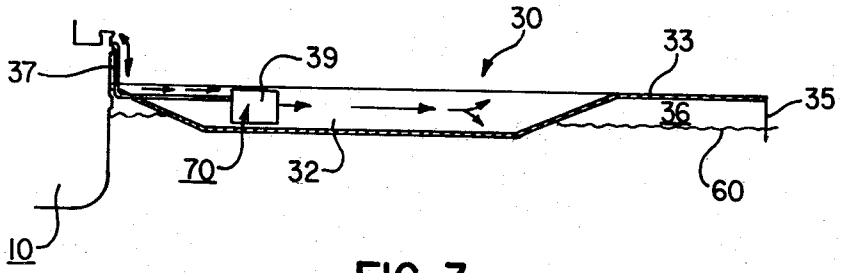
FIG. 3 is a section through line III-III of FIG. 2.

Description of FIGS. 2 and 3

As seen in FIGS. 2 and 3, floating modules 30 comprise a floating barge section 32 and a cantilever section 33. Skirt 35 depends from the outboard end of cantilever section 33 to slightly below the water surface 60, thereby forming an air compartment 36 below the cantilever section 33.

Barge section 32 is provided with a forced air heating system 70 which makes use of heat, partially the waste thermal energy from the drillship 10. Warm waste water pipe 37 from the drillship 10 is connected to the warm waterinput of an indirect contact heat exchanger 39, and the thus cooled water returns to the drillship 10 via return line 38. The heating system 70 is provided with the use of suitable fans and ducts (not shown) in order to distribute hot air in a manner and quantity sufficient to prevent formation of ice under the canopy system.

Disposed between each floating module 30 and connected thereto is a roof module 40. The warm air from the forced air heating system 70 is circulated through the floating barge section 32, then through cantilever section 33 and thence into the roof module 40 and back again to the heating system 70.

A stream of warm air is injected into the skirt 35 to keep the skirt free of ice. This method and structure is disclosed and claimed in copending U.S. application Ser. No. 054,998 filed on July 5, 1979 (the relevant portion thereof being incorporated herein by reference).

Figure 4:
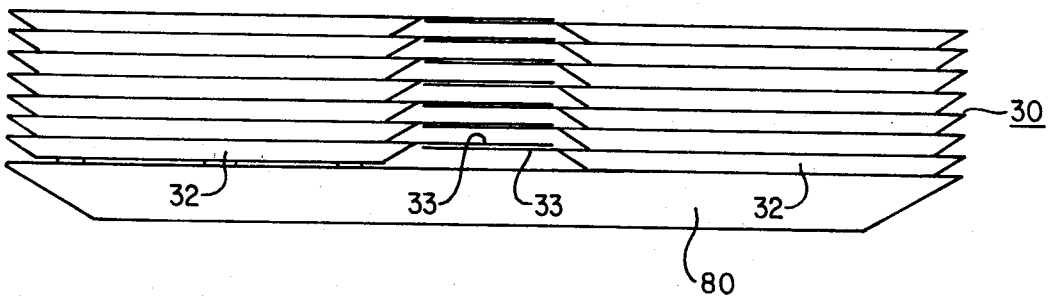
FIG. 4 is a side view of the transportation system for deploying the barges used in the apparatus of the present invention.

Description of FIG. 4

While FIG. 1 shows the barge system already deployed, it is nevertheless necessary to transport the barge system easily from one location to another, as the drillship 10 is shifted from one drilling site to another. FIG. 4 shows an embodiment of the present invention for transporting and relocating the barge modules. Special carrier barge 80 is used to support the barge modules in a stacked formation. Once at the site, the modules are moved from the carrier barge 80 by means of a ship's crane. An appropriate spreader system is used to distribute and support the modules. Pre-assembled roof modules are similary put in place. Deployment of the pre-assembled barge and roof modules once they arrive on site is carried out expeditiously. Activation of the heating system involves only connection of two flexible hoses and a power supply to each of the barge modules.

Disconnection of the barge system can be carried out, for example, within a few hours. It requires hose and power, mooring line, and membrane cover (over the gap between barge and ship) disconnection. If the ship changes location, the barges can either be towed in a train or restacked on the carrier barge and transported.

Summary

To summarize, the present invention provides a method and apparatus of maintaining a substantially ice-free zone around a drillship, consisting of the set of floating barges deployed around the perimeter of the ship, spaced one barge width apart with an intermodular roof connecting the barges. The entire perimeter of the system is enclosed with a flexible skirt which permits ice movement underneath while sealing the heat within into the system. A forced air heating system is integrated into the barge modules to distribute air at least partially heated by the drillship waste heat, in a manner and quantity sufficient to prevent ice formation under the barge hulls and roofs.

Once deployed, the barge system operates virtually automatically. The barge system is thermostatically controlled for optimal heat distribution. Snow clearing and temperature and ice movement monitoring are the only operating functions apart from regular inspections and maintenance required for barge system operation.

From the foregoing description, one skilled in the art can easily ascertain the essential characteristics of this invention, and without departing from the spirit and scope thereof, can make various changes and modifications of the invention to adapt it to various usages and conditions. Consequently, such changes and modifications are properly, equitably, and "intended" to be, within the full range of equivalence of the following claims.

We claim:

1. A method for providing a substantially ice-free zone to a predetermined distance around a vessel which is floating on a body of water, comprising the steps of:

(a) floating said vessel on a portion of said body of water in which said substantially ice-free zone o;s to be provided;

(b) creating a finite, substantially enclosed annular zone of water around said vessel above the waterline of said vessel to said predetermined distance away from said vessel, said zone of water having a periphery which encroaches said water at said waterline;

(c) continuously circulating warm air derived from a source of heat from said vessel to said substantially enclosed zone, and withdrawing cooler air from said substantially enclosed zone to said source of heat in said vessel; and (d) establishing an air/water seal at the location where said zone encroaches said water thereby to prevent ice formation within said annular enclosed zone.

2. The method of claim 1 wherein said source of heat comprises warm waste water from said vessel, and wherein said warm air is generated by circulating said warm waste water through water/air heat exchangers.

3. The method of claim 2 wherein said step of continuously circulating warm air includes creating a plurality of sub-zones within said annular enclosed zone, including first and second sub-zones, discharging said warm air from said water/air heat exchangers to said first sub-zones, and returning cooler air from said second sub-zones to said water/air heat exchangers.

4. A system for maintaining a substantially ice-free zone around a vessel which is floating on a body of water comprising, in combination with said vessel;

(a) a plurality of hollow modules extending completely around the periphery of said vessel, said modules including a first edge secured to said vessel, and a second edge, whereby said modules enclose an annular zone around the periphery of said vessel extending out to said second edge, and between the surface of said body of water and said modules;

(b) a peripheral skirt extending substantially around the entire periphery of said vessel, said skirt depending from said second edge of said modules and adapted to project dounwardly below the surface of said body of water; and (c) circulating means for circulating warm air into said annular enclosed zone surrounding said vessel, comprising a plurality of water/air heat exchangers associated with a predetermined number of said modules whereby said warm air can be generated from a source of hot water provided by said vessel, said water/air heat exchangers including a hot air outlet for circulating said warm air from said heat exchangers to said annular enclosed zone, and a cool air inlet for returning air from said annular zone to said water/air heat exchangers.

5. The system of claim 4 wherein said plurality of hollow modules comprises alternating floating barges and roof modules interconnected therewith.

6. The system of claim 5 wherein said floating barges include said air/water heat exchangers.

7. The system of claim 4 wherein said hollow modules comprise floating barges, including a floating barge section and a cantilevered canopy section terminating in said peripheral skirt.

8. The system of claim 7 wherein said floating barges include said air/water heat exchangers.

* * * * *